US008091396B2

(12) United States Patent
Irie et al.

(10) Patent No.: US 8,091,396 B2
(45) Date of Patent: Jan. 10, 2012

(54) METHOD FOR FORMING AN END PORTION OF A CYLINDRICAL WORKPIECE

(75) Inventors: Tohru Irie, Nagoya (JP); Masashi Ota, Kariya (JP)

(73) Assignee: Sango Co., Ltd., Nishikamo-Gun (JP)

( * ) Notice: Subject to any disclaimer, the term of this patent is extended or adjusted under 35 U.S.C. 154(b) by 457 days.

(21) Appl. No.: 12/379,240

(22) Filed: Feb. 17, 2009

(65) Prior Publication Data

US 2009/0205386 A1 Aug. 20, 2009

(30) Foreign Application Priority Data

Feb. 19, 2008 (JP) ..... 2008-037877

(51) Int. Cl.
*B21D 22/00* (2006.01)
*B21D 3/02* (2006.01)

(52) U.S. Cl. ..... 72/84; 72/121

(58) Field of Classification Search ..... 72/80, 81, 72/84, 121, 370.1, 370.24, 370.25, 82, 83, 72/120

See application file for complete search history.

(56) References Cited

U.S. PATENT DOCUMENTS

| | | | | |
|---|---|---|---|---|
| 6,018,972 | A * | 2/2000 | Irie | 72/121 |
| 6,067,833 | A | 5/2000 | Irie | |
| 2008/0022741 | A1 | 1/2008 | Arai | |

FOREIGN PATENT DOCUMENTS

| | | |
|---|---|---|
| JP | B2-2957153 | 7/1999 |
| JP | B2-2957154 | 7/1999 |
| JP | A-2001-286955 | 10/2001 |
| JP | B2-3292570 | 3/2002 |
| JP | B2-3744390 | 12/2005 |
| JP | A-2007-14983 | 1/2007 |
| WO | WO 2005/056210 A1 | 6/2005 |

* cited by examiner

*Primary Examiner* — Dana Ross
*Assistant Examiner* — Mohammad I Yusuf
(74) *Attorney, Agent, or Firm* — Oliff & Berridge, PLC

(57) ABSTRACT

A method for forming a part of deformed cross section with non-rotation symmetry on an end portion of a cylindrical workpiece. The method includes steps of performing a first relative motion of a roller against the workpiece toward its one open end, and performing a second relative motion of the roller against at least a part of outer peripheral surface of the end portion of the workpiece toward the inside thereof, while the roller is rotated relative to the workpiece by one rotation, in such a state as being held to be in contact with the end portion, in a plane which is perpendicular to the moving direction of the first relative motion, and which includes a position where the roller contacts the outer peripheral surface of the end portion, and performing a rotational motion of the roller relatively rotating around the workpiece, while performing the second relative motion, with the roller being held to be in contact with the outer peripheral surface of the end portion. The first relative motion is performed up to a position exceeding the one open end, while repeating the second relative motion and the rotational motion.

5 Claims, 8 Drawing Sheets

METHOD FOR FORMING AN END PORTION OF A CYLINDRICAL WORKPIECE

BACKGROUND OF THE INVENTION

1. Field of the Invention

The present invention relates to a method for forming an end portion of a cylindrical workpiece, particularly the method for forming the end portion of the cylindrical workpiece by a spinning process, to form a part of deformed cross section with non-rotation symmetry on the end portion of the cylindrical workpiece, for example.

2. Description of the Related Art

Heretofore, a method for reducing an end portion of a metallic tubular member by a spinning process, to form a tapered portion and a small diameter cylindrical portion next to it has been known. Also, a method and an apparatus for forming a non co-axial small diameter cylindrical portion on an unprocessed portion of a cylindrical workpiece have been disclosed in prior patents such as Japanese Patent Nos. 2957153 and 2957154 (corresponding to U.S. Pat. No. 6,067,833). According to the spinning process, it has been known in the filed of casings for use in automobile exhaust system parts, for example, that a small diameter cylindrical portion having a circular cross section is formed on an end portion of the cylindrical workpiece integrally therewith, to be easily connected with a part to be connected. Furthermore, Japanese Patent Laid-open Publication Nos. 2001-286955 and 2007-014983 disclose a spinning process for reducing a diameter of an end portion of a tube having an oval cross section to provide a circular cross section, or a spinning process for reducing a diameter of an end portion of a pipe having a circular cross section to provide a non axially symmetrical shape such as an oval or polygon.

On the other hand, as for a method and apparatus for forming plate members, a method and an apparatus for forming the plate member into a hut shape of deformed cross section have been proposed in Japanese Patent No. 3292570 and International Publication No. WO2005/056210, and the similar process has been disclosed in Japanese Patent No. 3744390.

Recently, it has been required for exhaust parts of vehicles to be formed small in size, and in such a configuration as being capable of avoiding interference with other neighboring parts. In order to meet the requirement, the end portion of the metallic tubular member may have to be formed into the one having a non circular cross section, or formed with a recess at a portion to be possibly interfered with the neighboring parts, to provide a deformed cross section. In this case, it can be formed into the one having the non circular cross section according to the aforementioned Japanese Patent Laid-open Publication Nos. 2001-286955 and 2007-014983. However, as the roller is to be revolved along a revolutionary locus with rotation symmetric having a center, such as a circle, oval, elongated circle, or the like, it can not be formed into the one having a non-rotation symmetric cross section.

In contrast, according to the forming methods as described in Japanese Patent Nos. 3292570 and 3744390, and International Publication No. WO2005/056210, the plate member can be formed into the hut shape having the deformed cross section. However, those methods can not be applied to the cylindrical workpiece as they are. In addition, as they do not employ a sequential process, but they employ a single locus process, which is different from the spinning process as disclosed in the aforementioned prior publications, they can not be used for the spinning process applied to the end portion of the cylindrical workpiece.

SUMMARY OF THE INVENTION

Accordingly, it is an object of the present invention to provide a method for forming an end portion of a cylindrical workpiece by a spinning process, so as to form a part thereof having a deformed cross section with non-rotation symmetry.

In accomplishing the above and other objects, a method for forming an end portion of a cylindrical workpiece by a spinning process, with the cylindrical workpiece and at least one roller being relatively moved, and with the roller being rotated relative to the cylindrical workpiece, in such a state as being held to be in contact with each other, comprises steps of performing a first relative motion of the roller against the cylindrical workpiece toward one open end thereof, performing a second relative motion of the roller against at least a part of outer peripheral surface of the end portion of the cylindrical workpiece toward the inside of the cylindrical workpiece, while the roller is rotated relative to the cylindrical workpiece by one rotation, in such a state as being held to be in contact with the end portion of the cylindrical workpiece, in a plane which is perpendicular to the moving direction of the first relative motion, and which includes a position where the roller contacts the outer peripheral surface of the end portion of the cylindrical workpiece, performing a rotational motion of the roller relatively rotating around the cylindrical workpiece, performing the second relative motion, with the roller being held to be in contact with the outer peripheral surface of the end portion of the cylindrical workpiece on the perpendicular plane, and performing the first relative motion from the contacting position up to a position exceeding the one open end of the cylindrical workpiece, while repeating the second relative motion and the rotational motion. In this respect a motion cycle including the first relative motion, second relative motion and rotational motion is repeated by a plurality of cycles, so as to form a part of deformed cross section with non-rotation symmetry on the end portion of the cylindrical workpiece. The above contacting position may be set to a predetermined position for starting the process, or may be shifted toward one open end of the cylindrical workpiece sequentially according to progress of driving cycles.

In the method as described above, a first moving amount and a second moving amount may be provided on the basis of a difference between a configuration of the cylindrical workpiece to be applied with the spinning process and a target configuration of the cylindrical workpiece with the spinning process applied thereto, to perform the first relative motion and the second relative motion according to the first moving amount and the second moving amount, respectively.

A relative moving locus of the roller against the cylindrical workpiece may be provided on the basis of a difference between a configuration of the cylindrical workpiece to be applied with the spinning process and a target configuration of the cylindrical workpiece with the spinning process applied thereto, to perform the first relative motion, second relative motion and rotational motion along the relative moving locus.

The cylindrical workpiece to be applied with the spinning process may include a cylindrical portion and a reduced diameter end portion with at least one end portion of the cylindrical portion being reduced in diameter, and the reduced diameter end portion may include the end portion of the cylindrical workpiece to be processed, and the open end surface of the reduced diameter end portion corresponds to the one open end of the end portion of the cylindrical workpiece, to provide the contacting position on the reduced diameter end portion.

BRIEF DESCRIPTION OF THE DRAWINGS

The above stated object and following description will become readily apparent with reference to the accompanying drawings, wherein like reference numerals denote like elements, and in which.

DETAILED DESCRIPTION OF PREFERRED EMBODIMENTS

Figure 1:
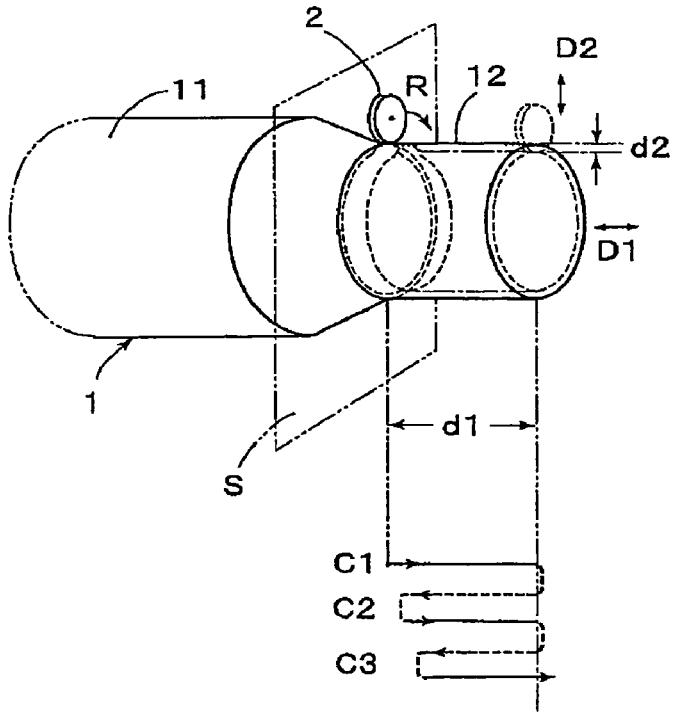
FIG. 1 is a perspective view showing a method for forming an end portion of a cylindrical workpiece according to an embodiment of the present invention.

As an embodiment of a method for forming an end portion of a cylindrical workpiece by a spinning process, FIG. 1 shows a perspective view to explain the method for forming a part of deformed cross section with non-rotation symmetry on the end portion of the cylindrical workpiece. The final products of the present embodiment are used for a muffler of an automobile, diesel particulate filter, purifying filter, intake or exhaust parts for use in a fuel cell, or other various pressure containers. Although the cylindrical workpiece to be processed is a stainless steel tube, other metallic tubes may be employed.

Figure 6:
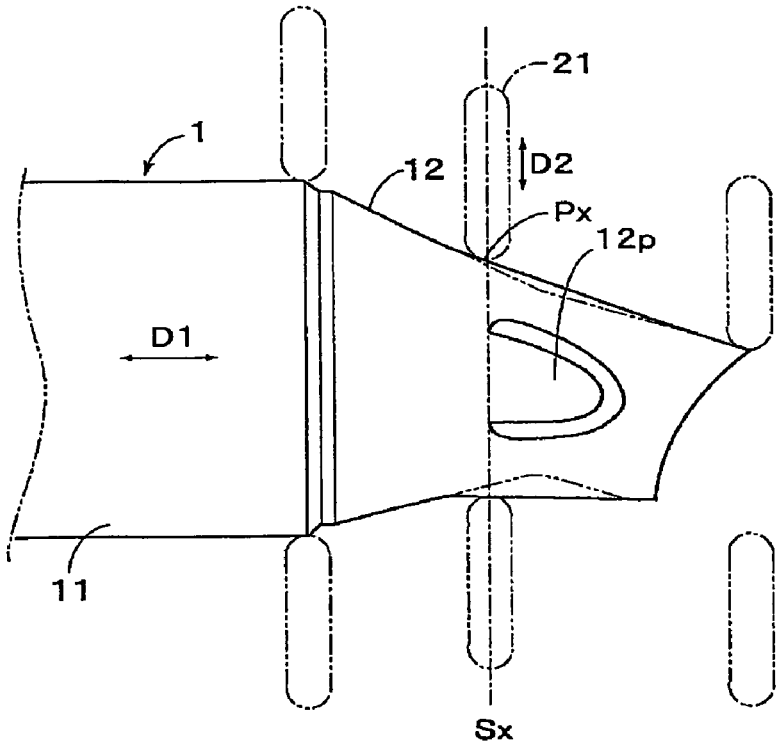
FIG. 6 is a side view of another example of an end portion of a cylindrical workpiece formed according to an embodiment of the present invention.

Referring to FIG. 1, an embodiment of the method for forming an end portion of a cylindrical workpiece 1 is achieved by performing a first relative motion (D1) of a roller 2 against the cylindrical workpiece 1 toward its one open end (rightward in FIG. 1), and performing a second relative motion (D2) of the roller 2 against at least a part of outer peripheral surface of the end portion of the cylindrical workpiece 1, e.g., parts indicated by broken lines in FIG. 1, toward the inside of the cylindrical workpiece 1, while the roller 2 is rotated relative to the cylindrical workpiece 1 by one rotation, in such a state as being held to be in contact with the end portion of the cylindrical workpiece 1, in a plane (S) which is perpendicular to the moving direction of the first relative motion (D1), and which includes a position where the roller 2 contacts the outer peripheral surface of the end portion of the cylindrical workpiece 1, and performing a rotational motion (R) of the roller 2 relatively rotating around the cylindrical workpiece 1, while performing the second relative motion (D2), with the roller 2 being held to be in contact with the outer peripheral surface of the end portion of the cylindrical workpiece 1 on the perpendicular plane (S). And, by performing the first relative motion (D1) from the contacting position up to a position exceeding the one open end of the cylindrical workpiece 1, while repeating the second relative motion (D2) and the rotational motion (R), and then repeating a motion cycle including the first relative motion (D1), second relative motion (D2) and rotational motion (R) by a plurality of cycles (C1, C2, C3 and so on), a part of deformed cross section with non-rotation symmetry, e.g., the part indicated by "12*p*" in FIG. 6, is formed on the end portion of the cylindrical workpiece 1. As a result, a moving locus of the roller 2 becomes a closed loop locus with non-rotation symmetry. That is, the locus shall be the one having no central point, such as n-th B-Spline curve, Bezier curve, NURBS (Non-Uniform Rational B-Spline) interpolation curve, or the like. In this case, the contacting position may be set to be a predetermined starting position of the process, or it may be set to be shifted sequentially toward the one open end of the cylindrical workpiece 1 in response to repetition of driving cycles, the latter of which has been employed in the present embodiment as shown in FIG. 1.

Figure 2:
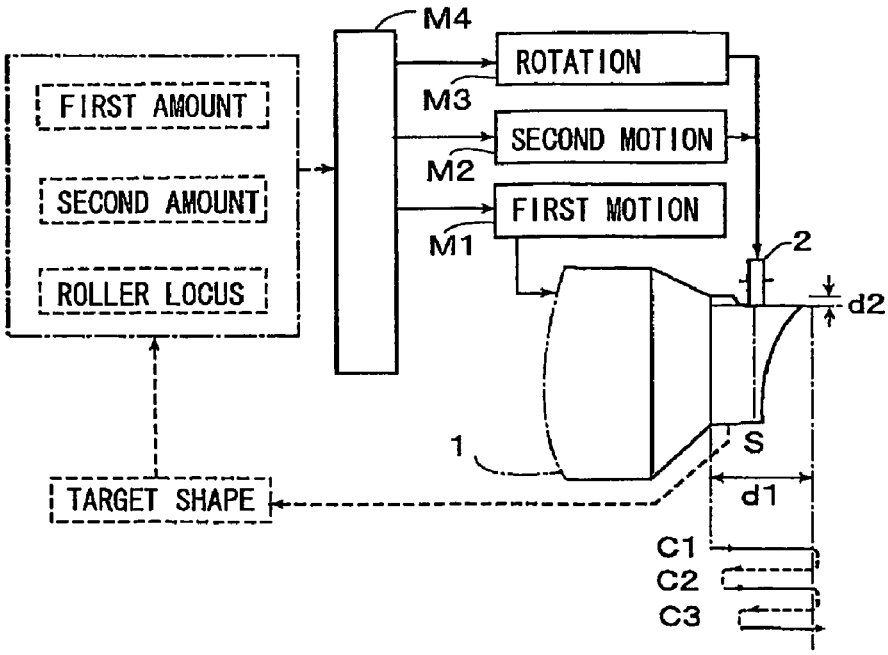
FIG. 2 is a schematic diagram showing an apparatus for forming an end portion of a cylindrical workpiece according to an embodiment of the present invention.

Referring to FIG. 2, there is schematically illustrated an apparatus for use in the embodiment as described above, and devices as shown in FIG. 3 are used, for example. In FIG. 2, a first relative motion device M1 is provided for performing the first relative motion (D1 in FIG. 1) of the roller 2 against the cylindrical workpiece 1 toward its one open end, and a second relative motion device M2 is provided for performing the second relative motion (D2 in FIG. 1) of the roller 2 against at least a part of outer peripheral surface of the end portion of the cylindrical workpiece 1 toward the inside of the cylindrical workpiece 1, while the roller 2 is rotated relative to the cylindrical workpiece 1 by one rotation, in such a state as being held to be in contact with the end portion of the cylindrical workpiece 1, in the plane which is perpendicular to the moving direction of the first relative motion, and which includes the position where the roller 2 contacts the outer peripheral surface of the end portion of the cylindrical workpiece 1. A rotational motion device M3 is provided for performing the rotational motion (R in FIG. 1) of the roller 2 relatively rotating around the cylindrical workpiece 1, with the roller 2 being held to be in contact with the outer peripheral surface of the end portion of the cylindrical workpiece 1 on the perpendicular plane. Then, it is so constituted that a controlling device M4 performs the first relative motion from the contacting position up to the position exceeding the one open end of the cylindrical workpiece 1, while repeating the second relative motion by the device M2 and the rotational motion by the device M3, and repeats the motion cycle including the first relative motion, second relative motion and rotational motion by a plurality of cycles (C1, C2, C3 and so on).

According to the present embodiment, the cylindrical workpiece 1 to be applied with the spinning process has a cylindrical portion 11 and a reduced diameter end portion 12, which was reduced in diameter of at least its one end portion, and the contacting position is set on the reduced diameter end portion 12, as shown in FIGS. 1 and 2. On the basis of a difference between the configuration of the cylindrical workpiece 1 to be applied with the spinning process (before the spinning process is applied to it) and a target configuration (as shown by a broken line in FIG. 1, and shown by a solid line in FIG. 2) of the cylindrical workpiece 1 with the spinning process applied thereto, e.g., dimensional differences d1 and d2, the first moving amount by the first relative motion, e.g., moving distance gradually reduced from the dimensional difference d1 according to progress of passes (cycles) C1, C2, C3 and so on, and the second moving amount by the second relative motion, e.g., moving distance of one third of the dimensional difference d2, are provided, so as to perform the first relative motion and the second relative motion according to the first moving amount and the second moving amount, respectively.

Or, on the basis of the difference between the configuration of the cylindrical workpiece to be applied with the spinning process and the target configuration of the cylindrical workpiece with the spinning process applied thereto, the relative moving locus (not shown) of the roller 2 against the cylindrical workpiece 1 may be provided, so as to perform the first relative motion, second relative motion and rotational motion along the relative moving locus. According to the present embodiment, it is provided that the roller 2 will move by the second moving amount (⅓ of d2), which corresponds to one driving cycle, while the roller 2 rotates one rotation from the contacting position in such a state as being held to be in contact with the end portion of the cylindrical workpiece 1. Therefore, the rotational amount around the cylindrical workpiece 1 corresponds to its one rotation resulted from the one driving cycle.

Figure 3:
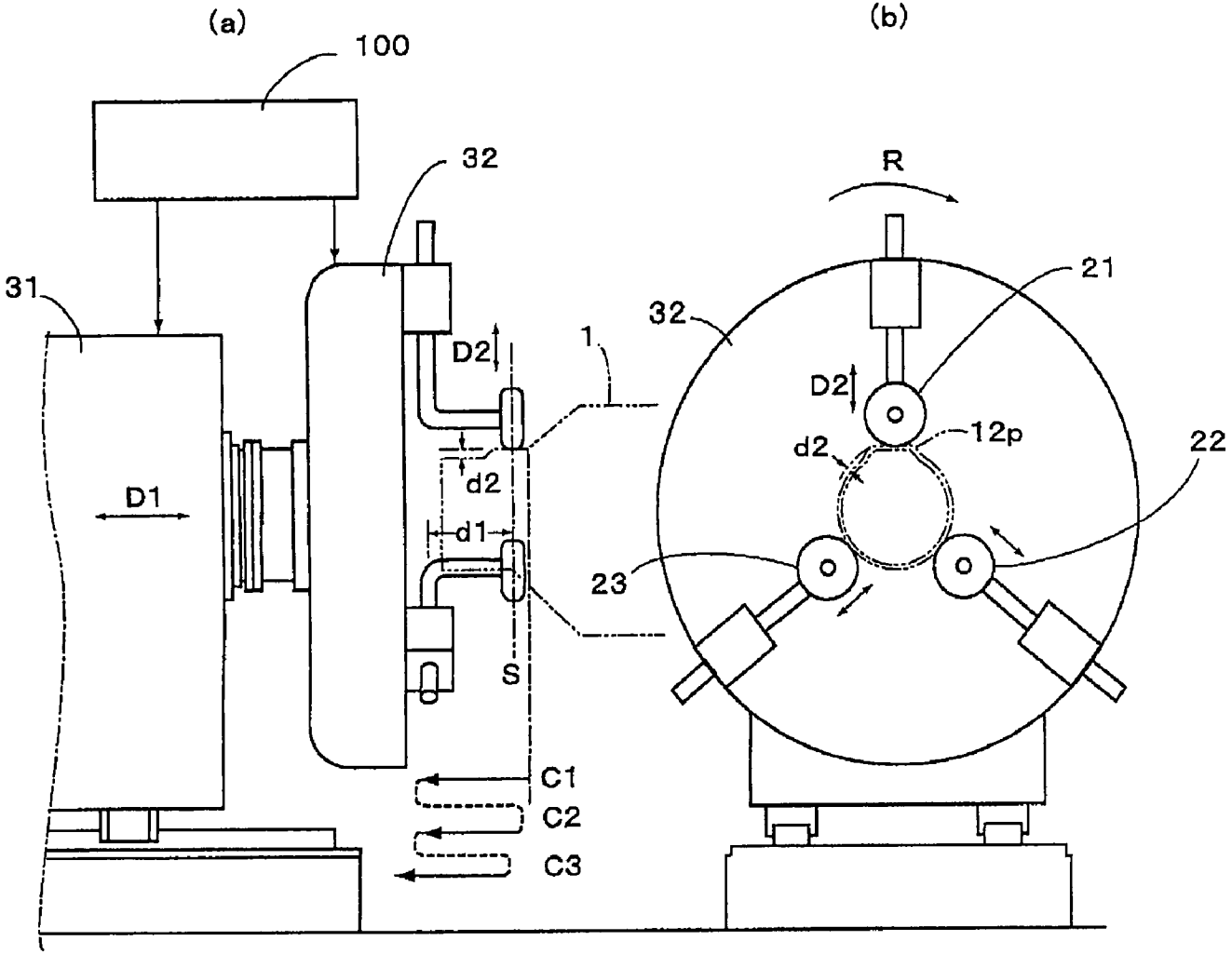
FIG. 3 illustrates a front view and a side view of a part of a practical apparatus for use in an embodiment of the present invention.

FIG. 3 shows a NC (numerical control) spinning apparatus, as a practical embodiment of the apparatus as shown in FIG. 2, which is provided with a driving mechanism 31 served as the first relative motion device M1, a driving mechanism 32 served as the second relative motion device M2 and rotational motion device M3 for driving the three rollers 21, 22 and 23, and a controller 100 served as the controlling device M4. The controller 100 is provided with a microprocessor, memory, input interface and output interface (not shown), from which the control signals are fed into the driving mechanisms 31 and 32 to perform the numerical control (NC). The references "S" and so on as indicated in FIG. 3 correspond to the references as indicated in FIGS. 1 and 2. According to the present embodiment, a so-called workpiece fixed type (non-rotating type) has been employed. However, a workpiece rotating type (non-revolving rollers type) may be employed, or both of them may be combined. Instead of the controller 100, a control circuit may be provided for each driving mechanism to perform a predetermined individual control, respectively. The rollers may not be limited to three, and may be disposed separately on each perpendicular plane for a plurality of cycles.

According to the driving mechanism 31, therefore, the rollers 21, 22 and 23 are driven to move toward one open end of the cylindrical workpiece 1 (leftward in FIG. 3(*a*)). And, by means of the driving mechanism 32, the rollers 21, 22 and 23 are driven to move toward the inside of the cylindrical workpiece 1, so as to be close to or remote from a part of outer peripheral surface of the end portion of the cylindrical workpiece 1, e.g., parts except for a convex part 12*p* as shown in FIG. 3(*b*), in such a state that the rollers 21, 22 and 23 are in contact with the cylindrical workpiece 1, in the perpendicular plane (S) including the contacting position to contact the outer peripheral surface of the end portion of the cylindrical workpiece 1. In this case, the aforementioned first and second moving amount for the relative motion between the cylindrical workpiece 1 and the rollers 21, 22 and 23 may be provided by a moving amount from a reference position, which is set by the intersection point of a moving axis (not shown) of the cylindrical workpiece 1 and the perpendicular plane (S), or provided by a displacement from an absolute reference position, which is set in a three-dimensional space. The motion of the cylindrical workpiece 1 driven by the driving mechanism 31 toward its one open end is performed from the contacting position up to the position exceeding its open end, and these driving cycles are repeated by a plurality of cycles (C1, C2, C3 and so on).

Figure 4:
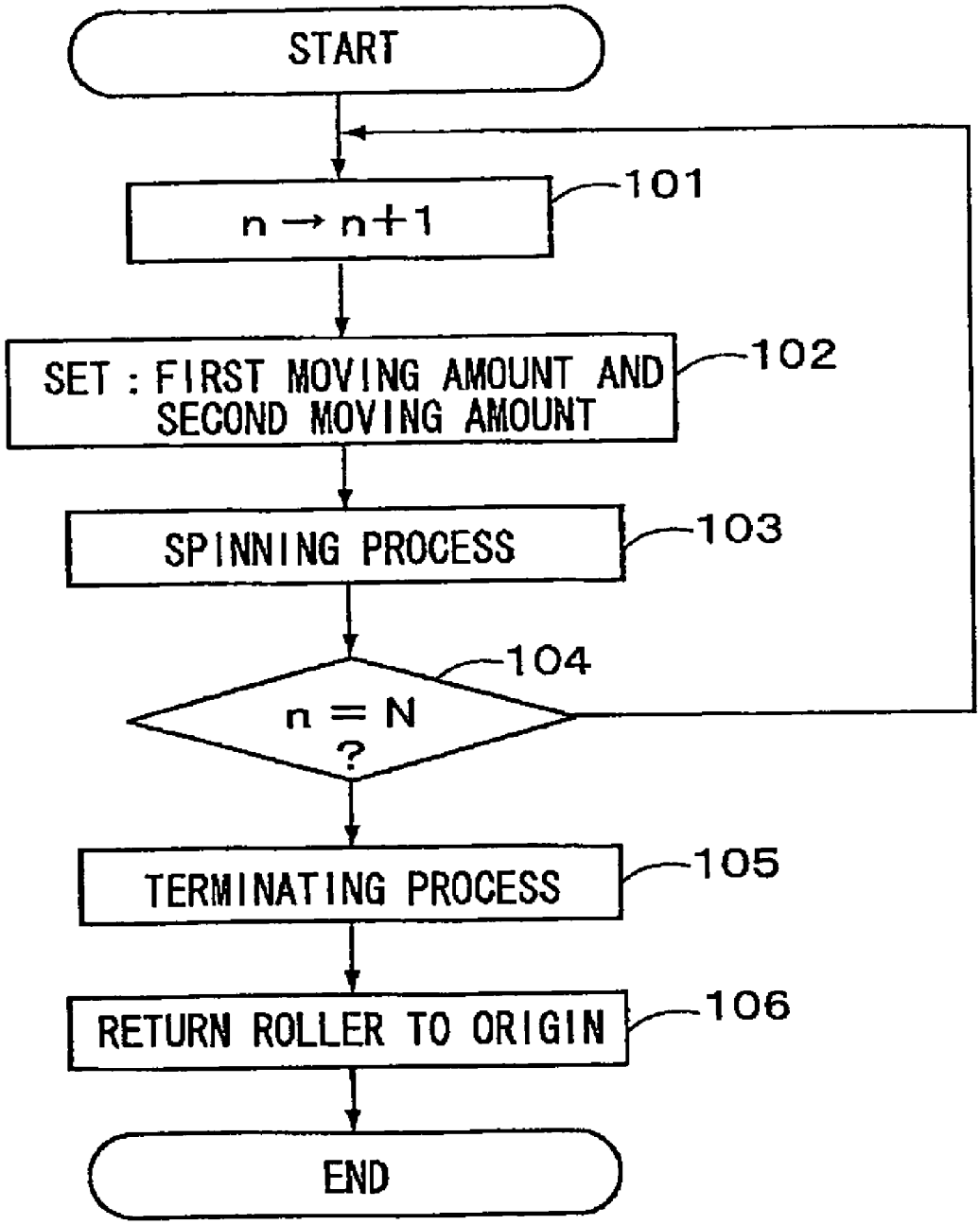
FIG. 4 is a flowchart showing an example of forming an end portion of a cylindrical workpiece according to an embodiment of the present invention.

FIG. 4 is a flowchart showing an example of the driving control by the controller 100. After a value (n) indicative of an initial position in each processing cycle is incremented at step 101, the first moving amount and the second moving amount are provided on the basis of the difference between the configuration of the cylindrical workpiece 1 to be provided with the spinning process and the target configuration of the cylindrical workpiece 1 with the spinning process applied thereto (d1 and d2) at Step 102. Based on the first moving amount and the second moving amount, the driving mechanisms 31 and 32 are driven at Step 103, to perform the spinning process against the aforementioned part of the cylindrical workpiece 1. Thus, the above spinning process is repeated until it is determined to have reached a predetermined processing cycle (N) at Step 104. When the spinning process is terminated, a terminating process is performed (to clear various kinds of memorized data and so on) at Step 105, and the rollers 21, 22 and 23 will return to their original positions (retracted positions) at Step 106.

Figure 5:
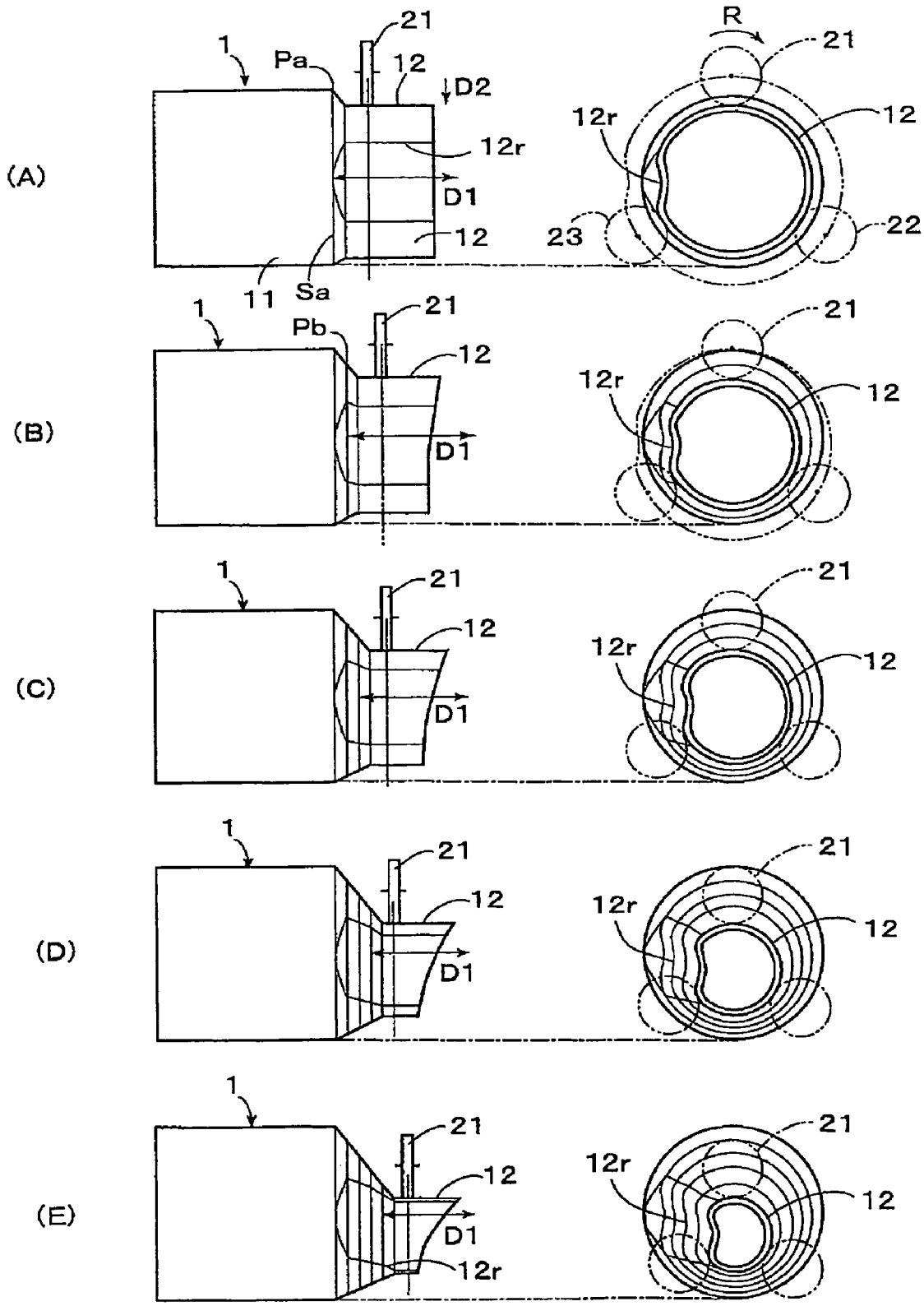
FIG. 5 is a process diagram showing an example of process for forming an end portion of a cylindrical workpiece according to an embodiment of the present invention.

FIG. 5 shows an example of process for reducing the one end portion of the cylindrical workpiece 1 by the aforementioned spinning process, to form the reduced diameter end portion 12 to be integral with the cylindrical portion 11, and form a concave portion 12*r* at its side surface. In FIG. 5, (A)-(E) show a series of processes (spinning cycles), as an example of a sequential spinning process, wherein each target configuration of a portion to be processed is provided in each cycle, and processed to be gradually close to a desired configuration. At the step (A), the rollers 21, 22 and 23 are driven to be close to and remote from the inside of the cylindrical workpiece 1 along the whole periphery of the end portion of the cylindrical workpiece 1, i.e., the whole part thereof to constitute "at least a part" of the end portion, while the rollers 21, 22 and 23 performs one rotation relative to the cylindrical workpiece 1 in such a state as being held to be in contact with each other from the contacting position (Pa), where the rollers 21, 22 and 23 contact the outer peripheral surface of the end portion of the cylindrical workpiece 1, in the perpendicular plane (Sa) including the contacting position (Pa), to provide the second motion (D2). Therefore, at the portion where the concave portion 12*r* is formed, the rollers 21, 22 and 23 are driven to move largely toward the inside of the end portion of the cylindrical workpiece 1, comparing with other outer peripheral surface portions. During the above process, the motion of the cylindrical workpiece 1 toward its open end (rightward in FIG. 5), i.e., the first motion (D1), is performed up to the position exceeding its one open end. Then, the rollers 21, 22 and 23 return to a contacting position (Pb), or may be set to return to the contacting position (Pa). Next, the rollers 21, 22 and 23 are driven to be close to and remote from the inside of the cylindrical workpiece 1 along the whole periphery of the end portion of the cylindrical workpiece 1, while the rollers 21, 22 and 23 performs one rotation relative to the cylindrical workpiece 1, in such a state as being held to be in contact with each other, from the contacting position (Pb), where the rollers 21, 22 and 23 contact the outer peripheral surface of the end portion of the cylindrical workpiece 1, in the perpendicular plane including the contacting position (Pb). Thereafter, the process at each step of (C)-(E) is performed in the same manner as described above.

According to the present embodiment, the reduced diameter end portion 12 is formed to be coaxial with the cylindrical portion 11 at the steps of (A) and (B), whereas the reduced diameter end portion 12 is formed to be offset against the cylindrical portion 11 at the steps of (C)-(E). Or, the reduced diameter end portion 12 may be formed in an oblique or skewed relationships with the cylindrical portion 11. Thus, the reduced diameter end portion 12 can be formed in any one of an offset, oblique or skewed relationships with the cylindrical portion 11. Also, the convex portion 12*p* as shown in FIG. 1 and concave portion 12*r* as shown in FIG. 5 can be formed at a desired position of the reduced diameter end portion 12 at the same time as the process for reducing its diameter. Furthermore, the open end portion (tip end portion) of the reduced diameter end portion 12 may be formed to provide a circular cross section without forming the convex portion 12*p* and concave portion 12*r* at the step (E), so as to be easily connected to another part, so that a connecting portion having a circular cross section can be formed in a series of steps of the spinning process. The tip end portion of the reduced diameter end portion 12 will be cut off after the step (E), to form a circular end surface.

Figure 7:
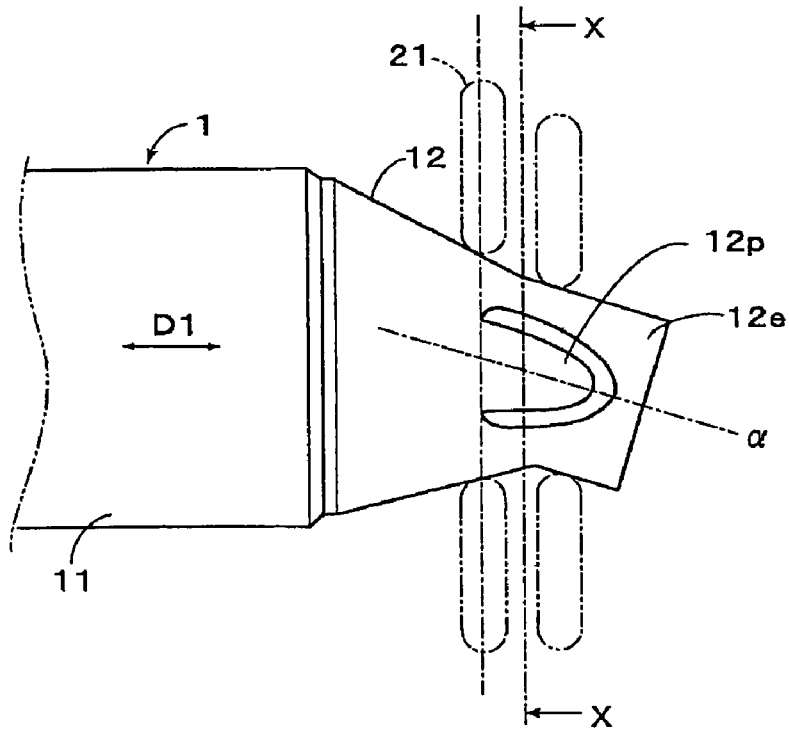
FIG. 7 is a side view of a further example of an end portion of a cylindrical workpiece formed according to an embodiment of the present invention.
Figure 8:
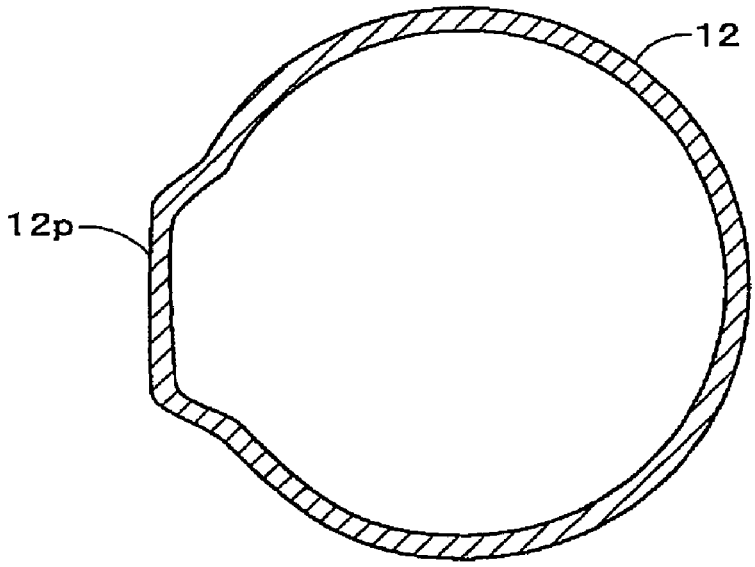
FIG. 8 is a cross sectional view sectioned along X-X line in FIG. 7.
Figure 9:
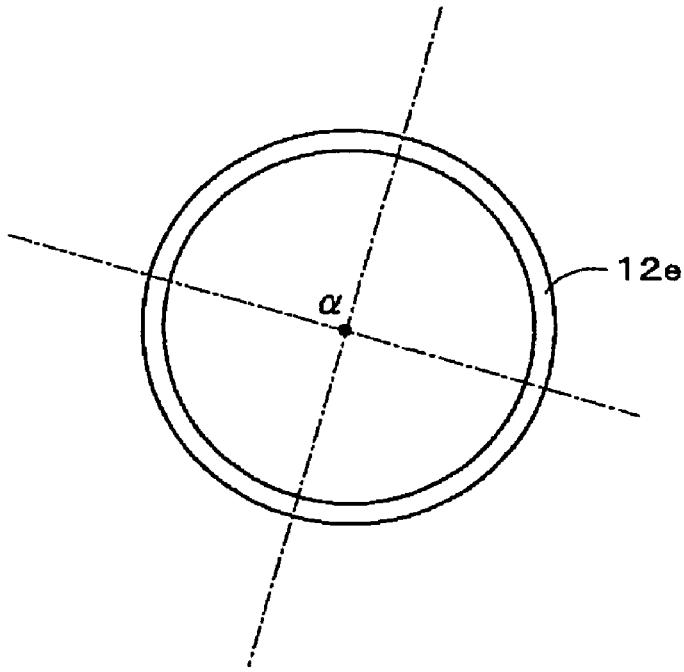
FIG. 9 is a front view of an open end portion as show in FIG. 7.

Next, FIGS. 6-9 show another example processed to the end portion of the cylindrical workpiece 1, and FIGS. 6 and 7 show a step for forming the convex portion 12*p* on the end portion of the cylindrical workpiece 1. It is formed into the one having a rotation symmetric cross section of a circle or elongated circle up to a contacting position (Px), which is the starting point for forming the convex portion 12*p*, and from which the second relative motion (D2) and rotational motion (R) are performed in such a state that the roller 21 and so on are in contact with the outer peripheral surface of the reduced diameter end portion 12, in a plane (Sx) perpendicular to the moving direction of the first relative motion (D1), in the same manner as the aforementioned embodiment, whereby the deformed cross section part having the convex portion 12*p* is formed at a part of the cylindrical workpiece 1 toward its one open end. In FIG. 6, a two-dot chain line as indicated inside of a tapered surface shows its configuration formed into the one having a shape of hour glass, which is to be a target for the process in FIG. 7. When the spinning process is applied to the reduced diameter end portion 12 in FIG. 6 to form the shape of hour glass, therefore, a cylindrical open end portion 12*e* having an axis α oblique to the central axis (same as the direction of D1) of the cylindrical portion 11 is formed. FIGS. 8 and 9 show a cross section as viewed from X-X and the end surface of the reduced diameter end portion 12*e*, respectively, from which the convex portion 12*p* extends in the radial direction outside of the cylindrical tip end portion.

Figure 10:
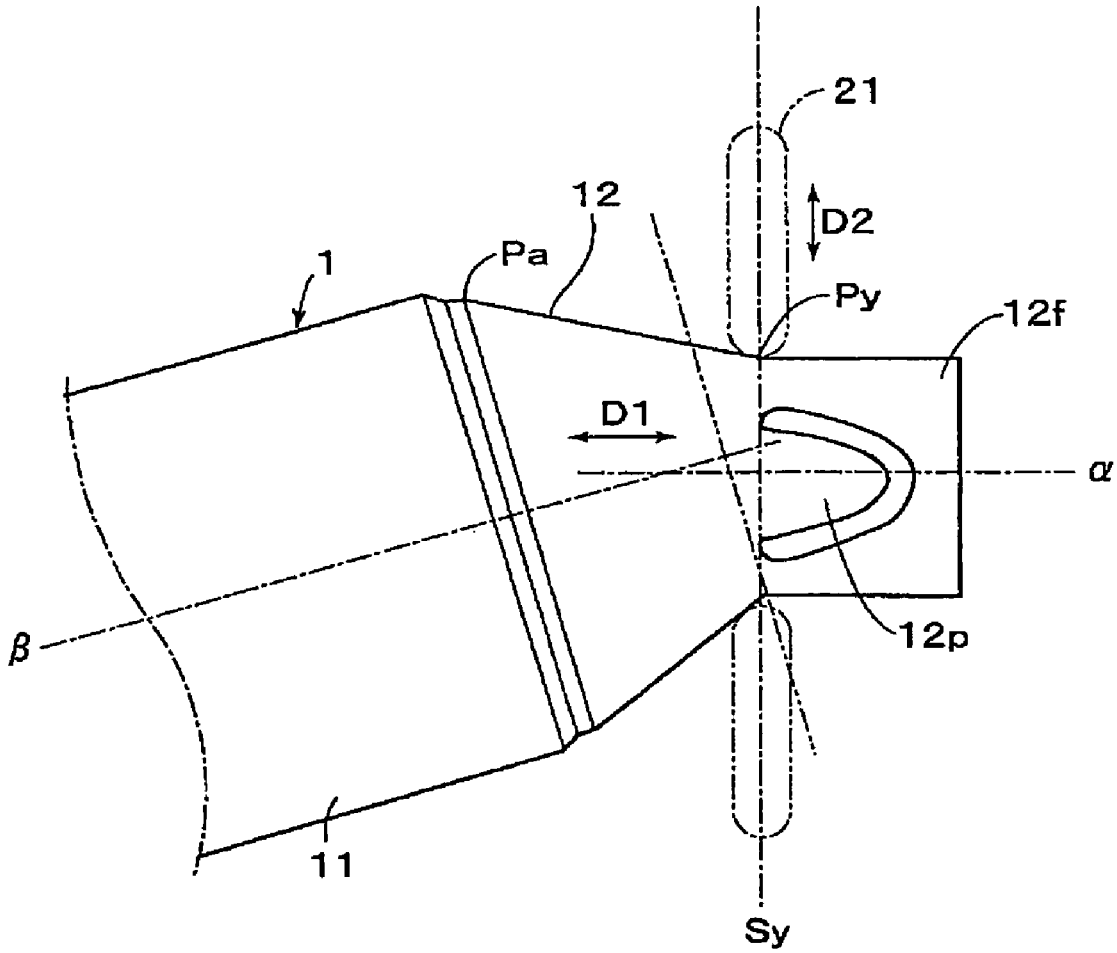
FIG. 10 is a side view of a further example of an end portion of a cylindrical workpiece formed according to an embodiment of the present invention.

FIG. 10 shows a further example of forming process to the one end portion of the cylindrical workpiece 1, wherein after the reduced diameter end portion 12 is formed into the one having the rotation symmetric cross section of the circle or elongated circle, the direction of relative motion of the rollers 21 and etc. against the cylindrical workpiece 1, i.e., the direction of the first relative motion (D1) is changed to be a different direction, at a contacting position (Py) served as the starting point for the process to the convex portion 12*p*, and therefore a plane (Sy) perpendicular to it is changed to be different from the plane (Sx) as shown in FIG. 6, and the spinning process is performed in the same manner as described above. Consequently, the deformed cross section part having the convex portion 12*p* is formed at a part of the cylindrical workpiece 1 from the contacting position (Py) toward its one open end. As shown in FIG. 10, therefore, at the reduced diameter end portion 12, a cylindrical open end portion 12*f* having an axis α oblique to the central axis (β in FIG. 10) of the cylindrical portion 11 is formed. Particularly, according to the forming process as shown in FIG. 10, the open end portion 12*f* is formed with its tip end portion of higher circularity, comparing with the tip end portion of the open end portion 12*e* formed by the forming process as shown in FIGS. 6-9

As described above, according to any one of the embodiments, since it is so constituted that the second relative motion (D2) and rotational motion (R) are performed in such a state that the roller 21 and so on are held to be in contact with the outer peripheral surface of the reduced diameter end portion 12, in a plane (Sx in FIG. 6, Sy in FIG. 10) perpendicular to the moving direction of the first relative motion (D1), a cylindrical open end portion (not shown) having not only the axis α oblique to the central axis (β in FIG. 10) of the cylindrical portion 11, but also the axis in the skewed relationship therewith can be formed. When the spinning process against the reduced diameter end portion 12 is performed, the adjustment of the rollers 21 and so on as required for each locus on the perpendicular plane (Sx, Sy) provided for each process of the first and second relative motions (D1, D2) and rotational motion (R) can be easily achieved by means of interpolation provided in the NC function of the spinning apparatus of the present embodiment as shown in FIG. 3.

Figure 11:
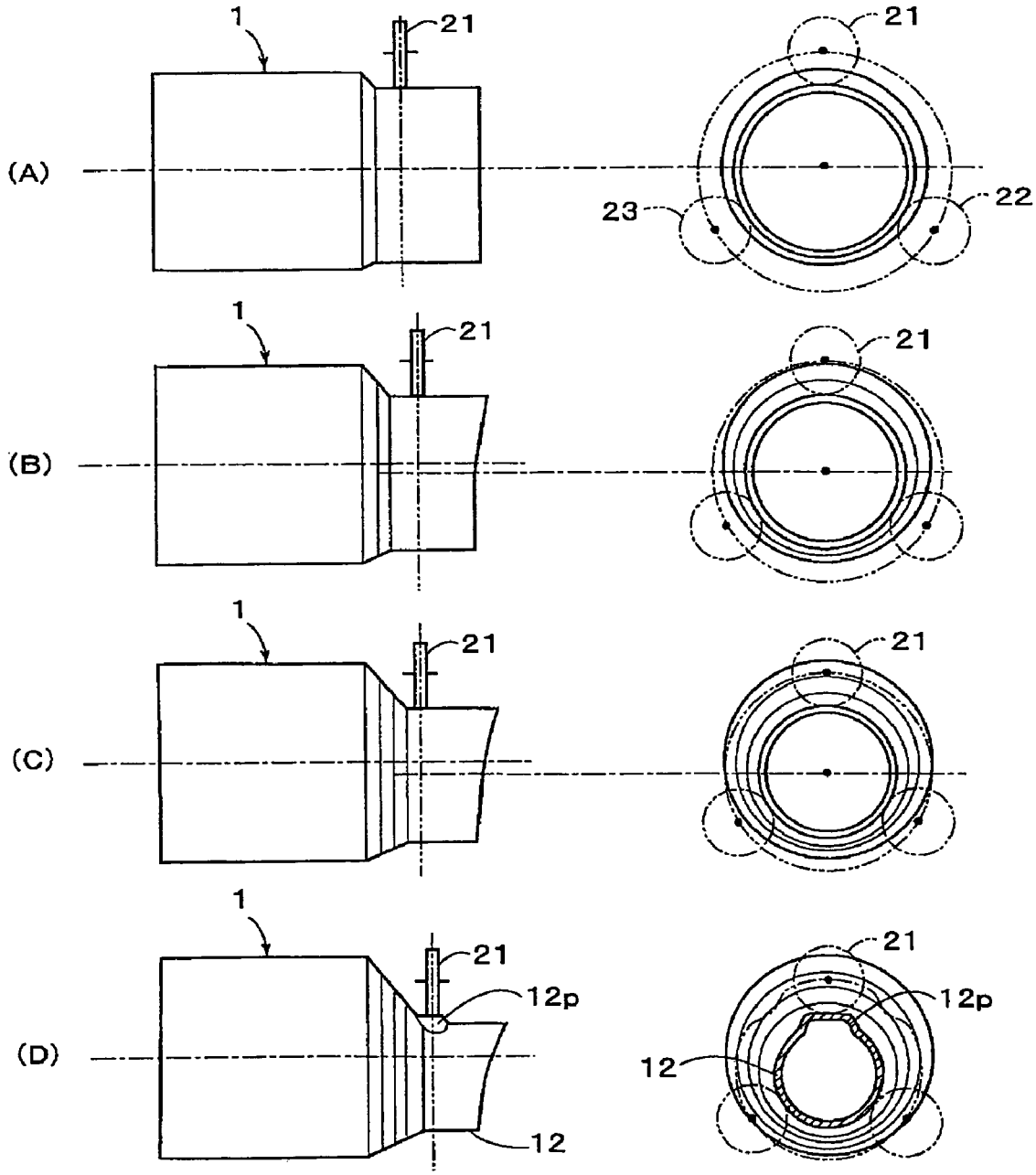
FIG. 11 is a process diagram showing another example for forming an end portion of a cylindrical workpiece according to an embodiment of the present invention.

As the convex portion 12*p* may be formed at only a part of the cylindrical workpiece 1, the spinning process as described in FIGS. 6 and 10 may be applied only to the part for forming the convex portion 12*p*, whereas the spinning process for forming its other portions may be of the known co-axial spinning process, or may be of the offset or oblique spinning process as described in the prior patents. FIG. 11 shows its example, wherein (A) employs the co-axial spinning process, (B) and (C) employ the offset spinning process, and wherein, against the cylindrical workpiece 1 formed by (C), the rollers 21 and so on are driven along a locus of closed loop with non-rotation symmetry at (D).

Accordingly, the convex portion 12*p* made on the reduced diameter end portion 12 as described above is formed with its tip end surface, which is made into a planar surface, and which is used as a base for a bracket or sensor (not shown). In the case where the cylindrical workpiece 1 to be formed by the present invention is used for a catalytic convertor, for example, a planar portion is required for mounting an oxygen sensor, temperature sensor, various brackets, heat insulator or the like (not shown). Heretofore, a separate spacer has been attached to the part formed by the spinning process. This spacer is a metallic member made by a forging process or cutting process, and called as a base block. A fine process is required to produce the spacer capable of being connected to a surface of 3-dimension, and also the spacer is required to be welded to the processed portion by the spinning process. In contrast, according to the embodiment as shown in FIGS. 6-10, the convex portion 12*p* can be made integrally on the reduced diameter end portion 12 by the sequential spinning process as described before, whereby a large cost down can be achieved.

The cross section of the end portion of the cylindrical workpiece 1 to be applied with the spinning process is not limited to the circular cross section, but it can be formed into the one having various shapes of oval, elongated circle (racetrack) or the like. Also, the cylindrical portion 11 of the workpiece 1 is not limited to the circle, oval, elongated circle or the like, and it can be formed into the one with various shapes of approximately trapezoid, triangle, quadrangle or the like. In addition, as described before, any of the offset, oblique and skewed spinning processes can be combined, an effective necking process can be provided.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method for forming an end portion of a cylindrical workpiece by a spinning process, with the cylindrical workpiece and at least one roller being relatively moved, and with the roller being rotated relative to the cylindrical workpiece, in such a state as being held to be in contact with each other, comprising:

performing a first relative motion of the roller against the cylindrical workpiece toward one open extremity thereof;

performing a second relative motion of the roller against at least a part of outer peripheral surface of the end portion of the cylindrical workpiece toward an inside of the cylindrical workpiece, so as to be close thereto or remote therefrom, while the roller is rotated relative to the cylindrical workpiece by one rotation, in such a state as being held to be in contact with the end portion of the cylindrical workpiece, in a plane perpendicular to the moving direction of the first relative motion, the plane including a position where the roller contacts the outer peripheral surface of the end portion of the cylindrical workpiece;

performing a rotational motion of the roller, relatively rotating around the cylindrical workpiece by performing the second relative motion, with the roller being held to be in contact with the outer peripheral surface of the end portion of the cylindrical workpiece on the perpendicular plane; and performing the first relative motion from the contacting position up to a position exceeding the one open extremity of the cylindrical workpiece, while repeating the second relative motion and the rotational motion; wherein a motion cycle including the first relative motion, second relative motion and rotational motion is repeated by a plurality of cycles, so as to form a part of a deformed axial cross section, the deformed axial cross section consequently possessing non-rotation symmetry, on the end portion of the cylindrical workpiece.

2. The method of claim 1, wherein a first moving amount and a second moving amount are provided on the basis of a difference between a configuration of the cylindrical workpiece to be applied with the spinning process and a target configuration of the cylindrical workpiece with the spinning process applied thereto, to perform the first relative motion and the second relative motion according to the first moving amount and the second moving amount, respectively.

3. The method of claim 1, wherein a relative moving locus of the roller against the cylindrical workpiece is provided on the basis of a difference between a configuration of the cylindrical workpiece to be applied with the spinning process and a target configuration of the cylindrical workpiece with the spinning process applied thereto, to perform the first relative motion, second relative motion and rotational motion along the relative moving locus.

4. The method of claim 1, wherein the cylindrical workpiece to be applied with the spinning process includes a cylindrical portion and a reduced diameter end portion with at least one end portion of the cylindrical portion being reduced in diameter, and wherein the reduced diameter end portion includes the end portion of the cylindrical workpiece to be processed, and the open end surface of the reduced diameter end portion corresponds to the one open extremity of the end portion of the cylindrical workpiece, to provide the contacting position on the reduced diameter end portion.

5. The method of claim 1, wherein three rollers are rotated relative to the cylindrical workpiece, and moved radially, being held to be in contact with the outer peripheral surface of the end portion of the cylindrical workpiece on the perpendicular plane relative to each forming target axis.

* * * * *